United States Patent [19]

Noack

[11] 4,265,103

[45] May 5, 1981

[54] RELATING TO COLD SHEET METAL ROLL FORMING APPARATUS

[76] Inventor: Jurgen Noack, 10 Winston Crescent, West Beach, South Australia, Australia

[21] Appl. No.: 32,889

[22] Filed: Apr. 24, 1979

[30] Foreign Application Priority Data

Apr. 21, 1978 [au] Australia ..... PD 4144/78
Apr. 21, 1978 [au] Australia ..... PD 4196/78

[51] Int. Cl.[3] ..... B21D 13/04

[52] U.S. Cl. ..... 72/180; 72/181; 72/226

[58] Field of Search ..... 72/181, 179, 182, 180, 72/248, 223, 226

[56] References Cited

U.S. PATENT DOCUMENTS

| | | | |
|---|---|---|---|
| 1,078,240 | 11/1913 | Barbour | 72/223 |
| 1,227,163 | 5/1917 | McKibbin | 72/223 X |
| 1,322,926 | 11/1919 | Miller | 72/181 |
| 3,009,511 | 11/1961 | Le Bouef, Sr. | 72/181 X |
| 3,772,531 | 12/1973 | McClain | 72/181 |
| 4,050,277 | 9/1977 | Malotte et al. | 72/181 |

*Primary Examiner*—Milton S. Mehr
*Attorney, Agent, or Firm*—Oldham, Oldham, Hudak & Weber

[57] ABSTRACT

A cold sheet metal forming apparatus in which the forming rolls are held at each end by bearing housings in each case held by screw-threaded rods engaging the housings and being secured directly to a main supporting frame.

Such an arrangement leaves additional room between adjacent pairs of rolls and a second set of rollers are nested between the first set also with the simplified support arrangement at each end of each roll so as to allow a second rolling line to be kept in position and available for prompt use without as has hitherto been the case the necessity to change rollers.

2 Claims, 3 Drawing Figures

RELATING TO COLD SHEET METAL ROLL FORMING APPARATUS

Figure 1:
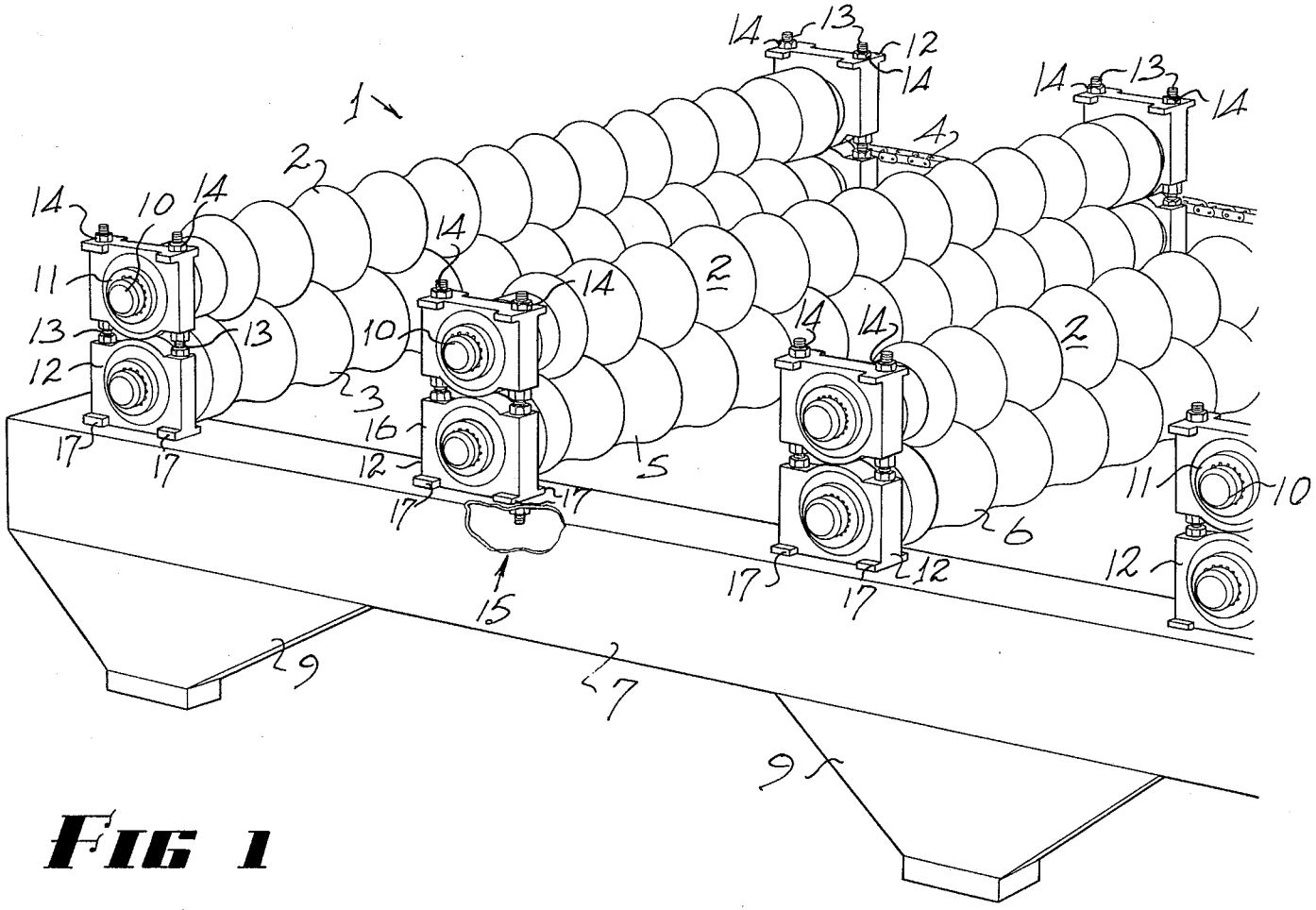

This invention relates to cold sheet metal roll forming apparatus.

As a background to the invention it is acknowledged as being conventional to have a cold sheet metal roll forming apparatus in which a metal sheet is fed from a roll between a plurality of rollers these being in pairs so that there is an upper and lower roller at each rolling location and the upper and lower roller in each case have a complimentary shape so as to provide a forming gap through which the sheet metal is fed and usually at least one of the rollers is driven so as to effect a drive of the sheet metal between the rollers.

This invention is directed to problems associated with the support of each of the rollers with respect to a main frame on which the rollers are collectively held.

A significant proportion of the cost of providing apparatus of this type lies in the arrangements for supporting the bearings with respect to the frame and of course the method of supporting such bearings must be both impracticable and of course long lasting and effective in the operation of the machine.

It is essential that whatever method is used, that each of the rollers must be able to be firmly held relative to the frame to ensure an accurate forming gap between the rollers and that this be held even with very significant deforming forces that may occur as well as substantial vibration.

At the same time, the method of support must be adjustable so that the relative positions of the rollers can be varied and indeed removable from time to time to allow for replacement rollers for different shapes.

A considerable proportion of the cost of apparatus for this purpose resides in the construction of the support system for each bearing and such supports have been the subject of substantive investigation over many years and the presently most commonly used device comprises in some sense a frame structure which has several lower legs secured to the main frame and then said legs and a crossing top member all arranged to achieve the answer of providing adjustment in position and holding bearing blocks in such an adjusted position with a secure hold against substantive forces.

Accordingly an object of this invention is to propose a system of support for rollers for the purpose described which can be manufactured significantly more economically than has hitherto been the case and yet will provide adequate adjustment and support for the rollers for the application.

It is a further object of this invention to provide a support system for rollers for the purpose described which is simple in concept and yet eminently practical in application and while it may means that adjustment of roller position may be a little more involved than has hitherto been the case, nonetheless it is eminently acceptable in terms of practicality.

According to a broadest concept then the invention could be said to reside in a cold sheet metal forming apparatus of a type in which a metal sheet is fed between, in succession, upper and lower complimentary shaped forming rollers so as to provide a shaped form in the metal sheet of constant cross section, each of the rollers being supported at each end by bearings so that each of the rollers rotate about an axis parallel with the axis of the other rollers and including drive means to synchronously rotate about the said axis at least some of the rollers the apparatus being characterized according to this invention in that the rollers are supported by a common frame by adjustable support means in which the bearing housings at the common end of a roller pair are supported by a screw-threaded rod at each side of each bearing housing, the end of each screw-threaded rod being secured to the supporting frame and nuts with screw-threads complimentary to the screw-thread of the respective rods being screwed on the rods in such a way as to hold the respective bearing housings firmly with respect to the frame.

There are a number of advantages that arise from such an arrangement but perhaps a suprising advantage is the fact that there can now be more clear space between adjacent support systems that is adjacent along the length of the machine.

One of the major problems associated with cold roll forming is the manner in which the apparatus needs to be used in a conventional rolling line.

Very often storage problems mean that it is better to store the sheet metal in roll form prior to rolling rather than subsequent to rolling and therefore rolling occurs more or less on demand.

This may means in a typical installation that perhaps only one or two hours per day of rolling are performed and thereafter the line is idle.

The line takes up ground space and also has considerable ancilliary equipment such as the roll feeding device the shear and the stacking devices at the end which are complimentary to the rolling function but nonetheless are normally adding to the overall capital cost of the apparatus and it will be good if some method could be devised whereby a longer working duty cycle could be devised of at least some of the equipment.

A perhaps surprising result of the method of support of the end bearings has meant that these are separated by greater distances than has hitherto been possible and this has left sufficient space to provide for an extra set of bearing supports which has meant that a second set of rollers that is with roller pairs at spaced apart intervals along the line can be in effect nested between and above the rollers of the primary line.

Accordingly, it is a preferred arrangement so far as the cold sheet metal forming apparatus is concerned in that there are positioned between at least some of the successively positioned roller pairs further pairs of rollers located so that their forming gap is of sufficient height to enable sheet metal to be rolled clearing the rollers of the first line of rollers.

It is of advantage to have the screw-threaded rods secured to a fabricated box section tightly secured or welded to the main frame so as to in effect provide an extension of the main frame support.

Indeed it would seem that a third line above the first and second could also be established if it was considered desirable.

The advantage of the second line at least is that the same surface area is used in a factory and furthermore, the same drive mechanism such as an electric motor and gearbox assembly can be used to drive the second line of rollers or at least sufficient of these to effect drive of sheet metal through the roller set, and the means for feeding the sheet metal into the rollers can be the same as for the first line and also the shear system can be the same as well as the stacking system in that these are all in the same position or sufficiently close that if necessary they can be slightly varied in position in the event that an alignment is necessary for best operation.

The enormous cost saving benefit will be apparent to any person familiar with this art and therefore the considerable advantage with such a concept provides for this art.

Figure 2:
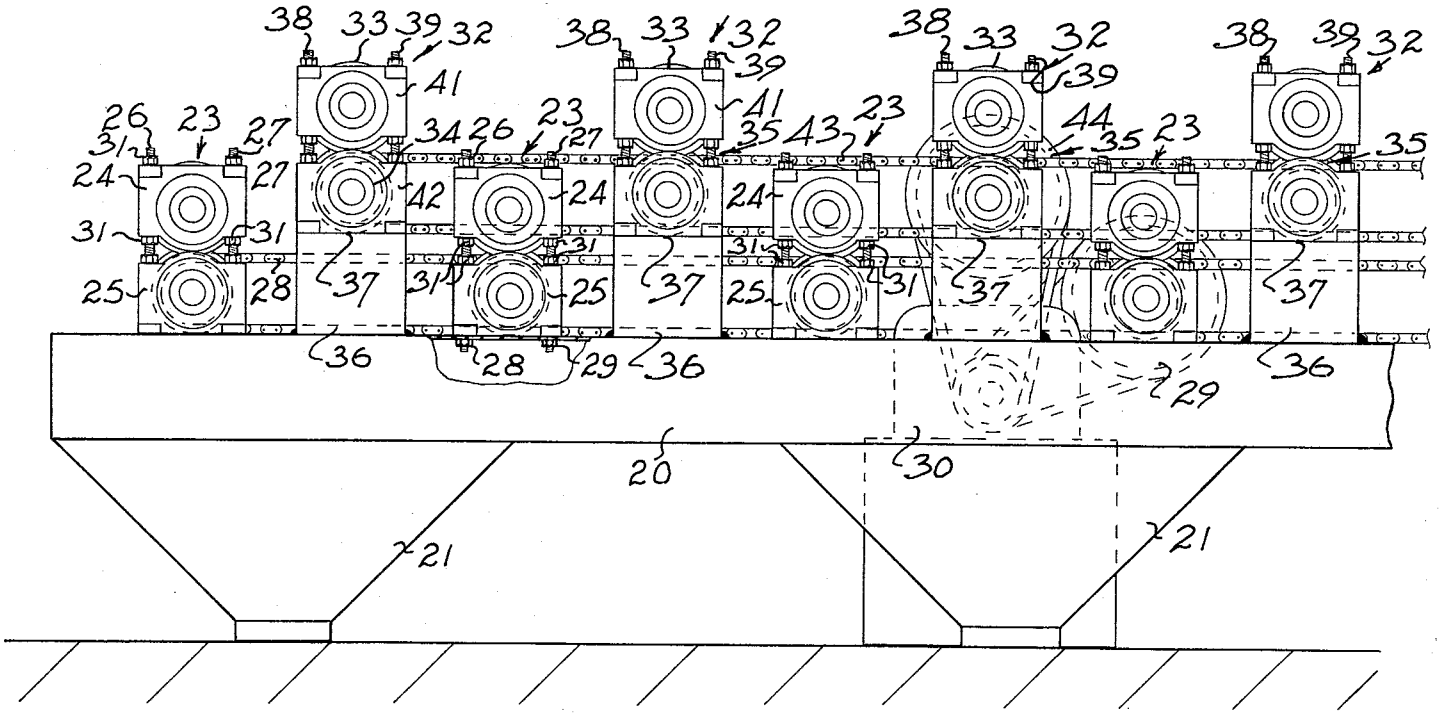
Figure 3:
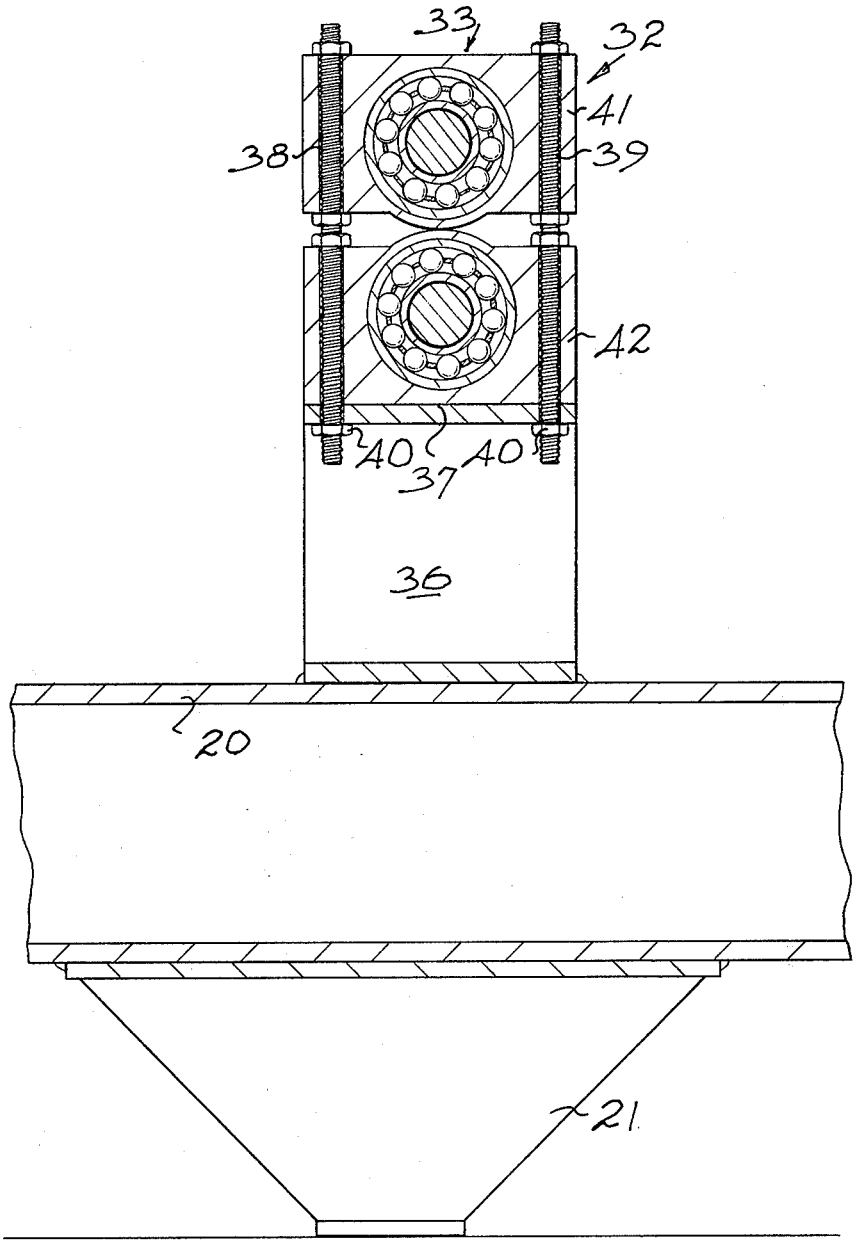

To more fully understand this invention reference shall now be made to preferred embodiments which shall be described with the assistance of drawings in which FIG. 1 is a perspective view of a sheet metal forming apparatus having the roller support arrangement according to the first preferred embodiment, FIG. 2 is a side elevation of a portion of a forming apparatus according to a second preferred embodiment, and FIG. 3 is a side elevation in cross-section of a portion of the arrangement of FIG. 2 illustrating in more detail the manner in which the screw-threaded rods pass through the bearing housings.

Referring to the drawings in detail and especially to the first preferred embodiment there is shown in general terms only a small part of a cold sheet metal forming apparatus 1 which has upper and lower rollers 2 and 3 being complimentary shaped so as to provide a shaped form in a metal sheet passing therebetween according to conventional practice.

There are a plurality of such pairs of rollers each having a support at each end so that each of the rollers rotates about an axis parallel with the axis of the other rollers.

In this preferred embodiment, the lower roller of each pair has a sprocket which is not specifically shown in the drawings which is coupled to a chain 4 which thereby synchronously rotates each of the lower rollers the other rollers being shown at 5 and 6 and of course the others not shown the chain 4 being driven by a drive means also now shown but according to standard techniques.

The support arrangement for each of the rollers is in general terms by reason of a frame 7 which in this case includes a longitudinal girder having a uppermost flat topped face 8 and which is supported by feet 9.

Each end 10 of the rollers is supported by a roller bearing 11 which is in turn held in a bearing housing 12 which as will be seen in the drawing comprises a cast metal structure which has two parallel and oppositely positioned apertures passing through each side and there are two such housings 12 for each pair of rollers and each of the housings is held by a screw-threaded rod 13 and nuts 14 a screw on the screw-threaded rod so as to in the first instance hold each rod 13 with respect to the frame member 7 as is shown at 15 and then holding the lower housing shown at 16 with respect to the girder 7.

Each bearing housing 12 has extended feet 17 which do assist in stability by providing a greater surface contact area between the housing 12 and the face 8.

The screw-threaded rods 13 are in each case parallel one with respect to the other and spaced apart and are in each case vertically orientated so that by adjustment of nuts 14 the relative position of the housing 12 and therefore the rollers can be made.

If a roll change is necessary at any time, each of the nuts 14 can be simply unscrewed from the respective threaded rods 13 and appropriate changes can thereby be made.

The arrangements shown shows then that by incorporating the very simple mechanical support system for the ends of the roller pairs first of all enables the cost of production of the machinery to be kept to a very low figure and perhaps most suprisingly it has been found that even with such a simple arrangement, the performance is very acceptable both from a practical and from an economical point of view.

A further advantage of the arrangement as will be seen in FIG. 1 is that the distance between each of the support assemblies for the ends of the rollers can be a significant distance apart or perhaps more importantly allow for additional location of a further support assembly.

According therefore to the second preferred embodiment as is shown especially in FIG. 2 a support frame 20 on feet 21 has secured thereto a first series of rollers 23 which include bearing housings 24 for the upper roller and bearing housing 25 for the lower roller and these in each case are held by two spaced apart screw-threaded rods 26 and 27 which are held at a lower end by a nut 28 and a nut 29 against the underneath face of the upper flat face of the frame member 20.

There is a sprocket at the outer end of the lower roller 25 to which the chain 28 is connected which is driven by sprocket drive 29 which is connected through the gearbox motor combination 30.

The bearing housings 24 and 25 in each case are held by nuts 31 as in the first embodiment.

However the feature of this second preferred embodiment is that there is a second set of pairs of rollers 32 which are complimentary in shape and there being an upper roller 33 and a lower roller 34 and the overall height of the forming gap 35 is such that a sheet of metal will clear the top of any of the other rollers of the first line 23.

To achieve this in a simple way, there is a fabricated box section 36 secured by welding to an upper edge of the frame member 20 and there is a flange at the upper end 37 to which the threaded rods 38 and 39 in each case are secured by having therebelow a nut 40 and once again each of the bearing housings 41 and 42 are secured by having an aperture passing fully through each side and being parallel and vertically orientated and of a slightly larger size than the cross section of the screw-threaded rod 38 or 39 so that the screw-threaded rods 38 and 39 which are parallel one with respect to the other and spaced apart and vertically orientated can be used to hold in a very acceptable way the two bearing housings.

A chain 43 likewise drives the lower roller of the pair 32 which is in turn driven by sprocket 44 which is selectively driven through gearbox motor combination 30.

It will now be seen that by using a simple support system which is not only economic but practical there can be the added advantage of having the additional rollers supported in a very convenient and economic way and in practice the advantage provides a very significant development in the art.

What is claimed is:

1. The cold sheet metal forming apparatus of a type in which a metal sheet is fed between in succession upper and lower complimentary shaped forming rollers so as to provide a shaped form in the metal sheet of constant cross section, each of the rollers being supported at each end by bearings so that each of the rollers rotates about an axis parallel with the axis of the other rollers and the apparatus including drive means to synchronously rotate about the said axis at least some of the rollers, the invention being characterized in that the rollers are supported by a common frame by adjustable support means in which the bearing housings at the common end of the roller pair are supported by a screw threaded rod at each side of each bearing housing, the end of each screw-threaded rod being secured to the supporting frame and nuts with screw threads complimentary to the screw thread of the respective rods being screwed onto the screw-threaded rods in such a way as to hold the respecting bearing housing firmly with respect to the frame;

further pairs of rollers positioned between at least some of the successively positioned roller pairs and located so that the forming gap is sufficiently high to enable a second forming line to be supported on the said common frame; and each roller pair having at each roller end by a separate bearing housing with the two housings at each end for each roller pair being held by the same two-threaded rods with one of the housings being vertically aligned above the other.

2. A cold sheet forming apparatus as in claim 1 further characterized in that each bearing housing is of cast metal and the aperture each side comprises a hold passing fully through from a top to a bottom of the housing.

* * * * *